United States Patent [19]

Garbark

[11] 4,354,681

[45] Oct. 19, 1982

[54] DROP TARGET ASSEMBLY FOR PINBALL GAME

[75] Inventor: Roman F. Garbark, Westchester, Ill.

[73] Assignee: D. Gottlieb & Co., Northlake, Ill.

[21] Appl. No.: 234,780

[22] Filed: Feb. 17, 1981

[51] Int. Cl.[3] ..... A63D 3/02

[52] U.S. Cl. ..... 273/121 R; 273/127 R

[58] Field of Search ..... 273/127 R, 121 A, 118 A, 273/119 A, 120 A, 127 D, 129 V

[56] References Cited

U.S. PATENT DOCUMENTS

| | | | |
|---|---|---|---|
| 4,212,466 | 7/1980 | Wildman et al. | 273/127 D X |
| 4,221,384 | 9/1980 | Krynski | 273/127 R X |
| 4,257,604 | 3/1981 | Grabel et al. | 273/127 R |
| 4,260,156 | 4/1981 | Momura | 273/127 R |

*Primary Examiner*—George J. Marlo

*Attorney, Agent, or Firm*—Arnold, White & Durkee

[57] ABSTRACT

An improved drop target assembly provides multiple target surfaces at a given drop target location. First and second target surfaces respectively are provided on first and second support members disposed in alignment such that the first member is in front of the second member, and the first target surface is in front of and shields the second target surface when the members maintain both targets in the above-playfield position. The first member is vertically moveable to drop the first target surface to a below-playfield position. This exposes the second target surface [exposed] for ball engagement. Preferably, a pair of switch contacts is provided behind the second target surface such that ball engagement of either the first target surface or the second target surface closes the switch contacts.

6 Claims, 4 Drawing Figures

DROP TARGET ASSEMBLY FOR PINBALL GAME

BACKGROUND OF THE INVENTION

The present invention relates generally to pinball games and more specifically relates to drop target assemblies for flipper type pinball games.

The popularity of pinball games is due to a large extent to the thought and ingenuity of the designers in incorporating new and different features to make the games more interesting and more exciting during play. One pinball game feature commonly employed by the pinball game designer is the so-called drop target. A drop target normally projects above the upper surface of the playfield and, when hit by a rolling ball projected by flippers or other devices, responds by dropping into a recessed position below the surface of the playfield.

An improved drop target assembly is described in U.S. Pat. No. 4,221,384, issued in the name of Edward P. Krynski (hereafter the Krynski patent). In this improved drop target assembly, ball engagement of one drop target drops not only that target but another target. While the improved drop target assembly in the Krynski patent is believed to have added to the pinball game designers repertoire of available features, additional novel improvements are continually sought.

SUMMARY OF THE INVENTION

The present invention provides yet another improvement in drop target assemblies for flipper type pinball games which presents a second target surface for ball engagement after the first target surface has been engaged by the ball and dropped below the playfield surface. The second target surface provides a visual appearance distinctive from that of the first target surface such that the appearing of the new appearance, coupled with the playfield activity of dropping the first target surface, promotes player interest and appeal.

According to one aspect of the invention, an improved drop target assembly for a flipper type pinball game comprises a frame and first and second target members. The first target member is movably supported by the frame for defining a first target area. The firs target member is movable to advance the first target area between a position above the surface of the playfield and a position below the surface of the playfield. The second target member is supported by the frame for defining a second target area. The second target member is disposed behind the first target member to enable the second target area to be ball engageable only when the first target area has been dropped to the below-surface position. A mechanism is provided for moving the first target member to thereby drop the first target area to the below-surface position upon ball engagement.

According to another aspect of the invention, the improved drop target assembly comprises a frame and at least first and second targets movably supported by the frame. The first target is movable between a position above the playfield surface and a position below the playfield surface. The first and second targets are disposed so that the first target shields the second target from ball engagement when the first target is in the above-surface position. A mechanism is provided for dropping the first target to the below-surface position upon ball engagement of the first target, thereby exposing the second target for ball engagement.

Preferably, the first and second targets are configured in substantially the same shape but of different colors or other visual indicia to promote player appeal. A mechanism is provided for resetting the first target to advance it to the above-surface position.

Further, the second target preferably is supported with respect to the frame for movement substantially only in the direction parallel to the surface of the playfield. This movement of the second target actuates a set of switch contacts.

Accordingly, it is a general object of the present invention to provide a new and improved drop target assembly featuring multiple target surfaces.

BRIEF DESCRIPTION OF THE DRAWINGS

The above noted and other objects and advantages of the present invention will become apparent upon reading a detailed description of a preferred embodiment in conjunction with the appended drawings.

DESCRIPTION OF A PREFERRED EMBODIMENT

Figure 1:
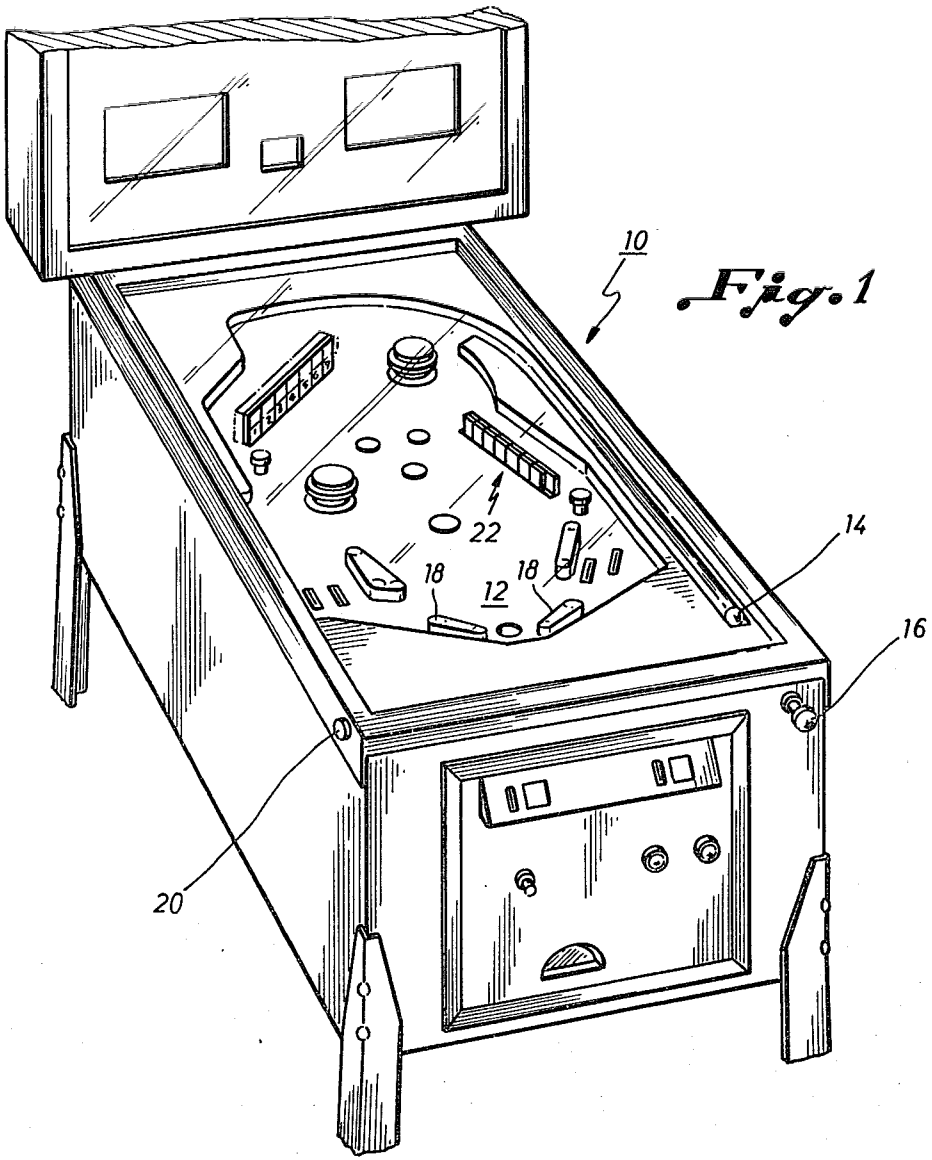
FIG. 1 is a perspective view of a playfield schematically illustrating an improved drop target assembly according to the present invention.

Referring now to the drawings, a typical pinball game machine 10 is disclosed in FIG. 1 having an inclined playfield 12 in which a ball 14 is shot into play by means of a spring plunger 16. The ball is kept in play by means of a set of flippers 18 which is responsive to actuation of a pair of button switches 20 positioned along the sides of the machine 10. A suitable controller (not shown) operates the typical pop bumpers, displays, etc. according to known techniques.

In accordance with one aspect of the present invention, the playfield 12 includes a new and improved drop target assembly, indicated schematically at 22 in FIG. 1. Specifics of two embodiments of the drop target assembly 22 are shown in detail in the subsequent figures. Both embodiments are constructed to achieve the outstanding feature of providing multiple target areas for a given drop target position at a given annular orientation with respect to the flippers 18.

Figure 3:
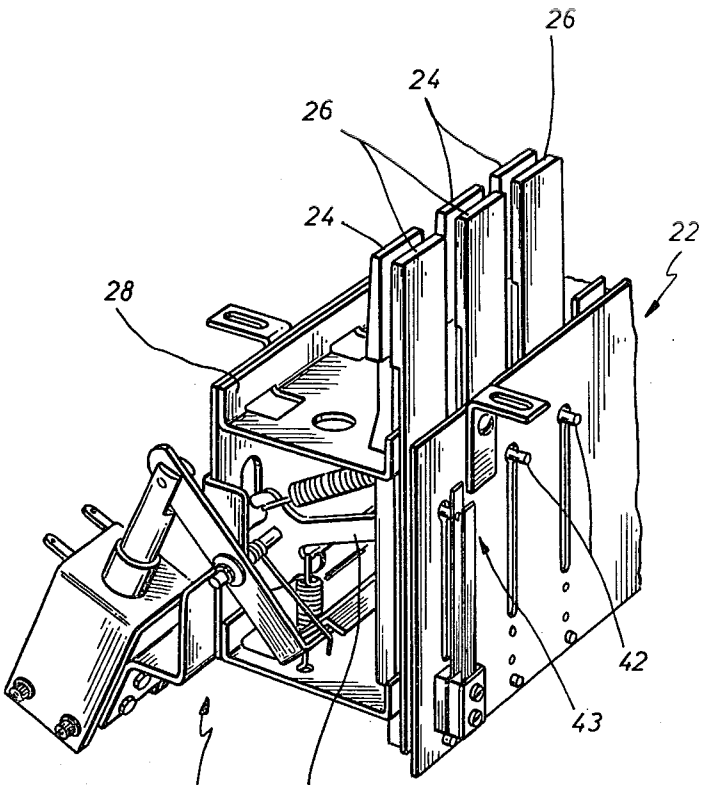
FIG. 3 is a partial backside perspective of the drop target assembly of FIGS. 2A, 2B in association with the playfield.
Figure 2B:
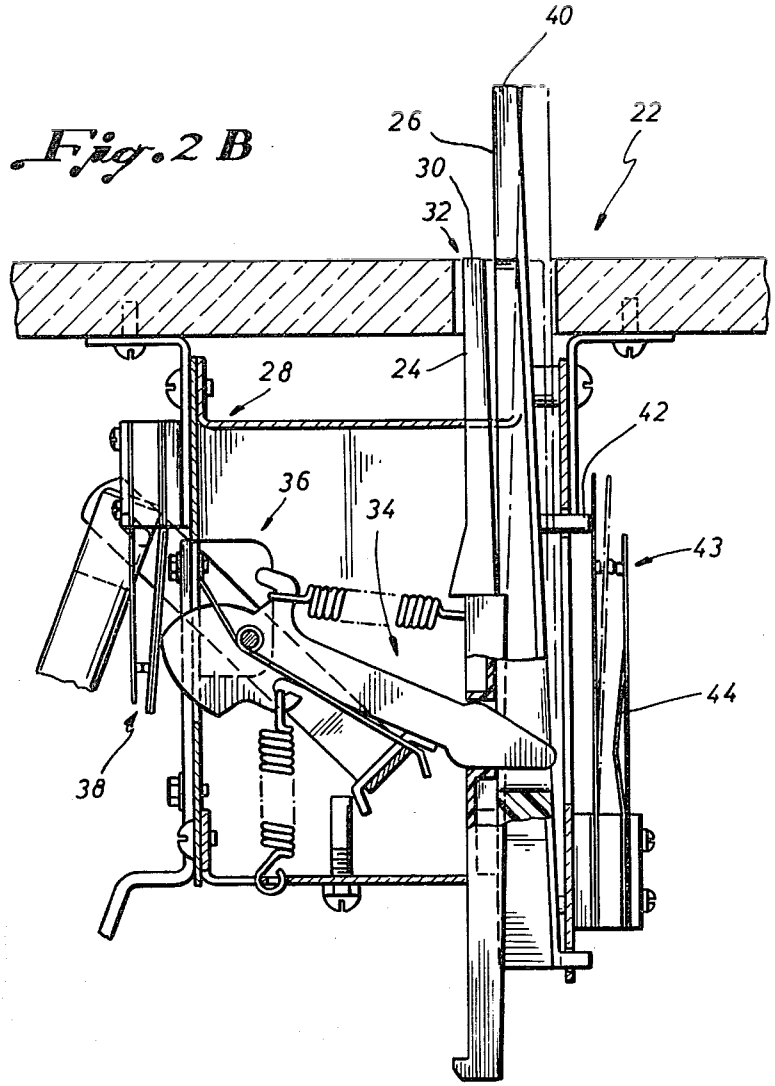
FIGS. 2A and 2B are cross-sectional side views of the drop target assembly associated with the playfield of FIG. 1.
Figure 2A:
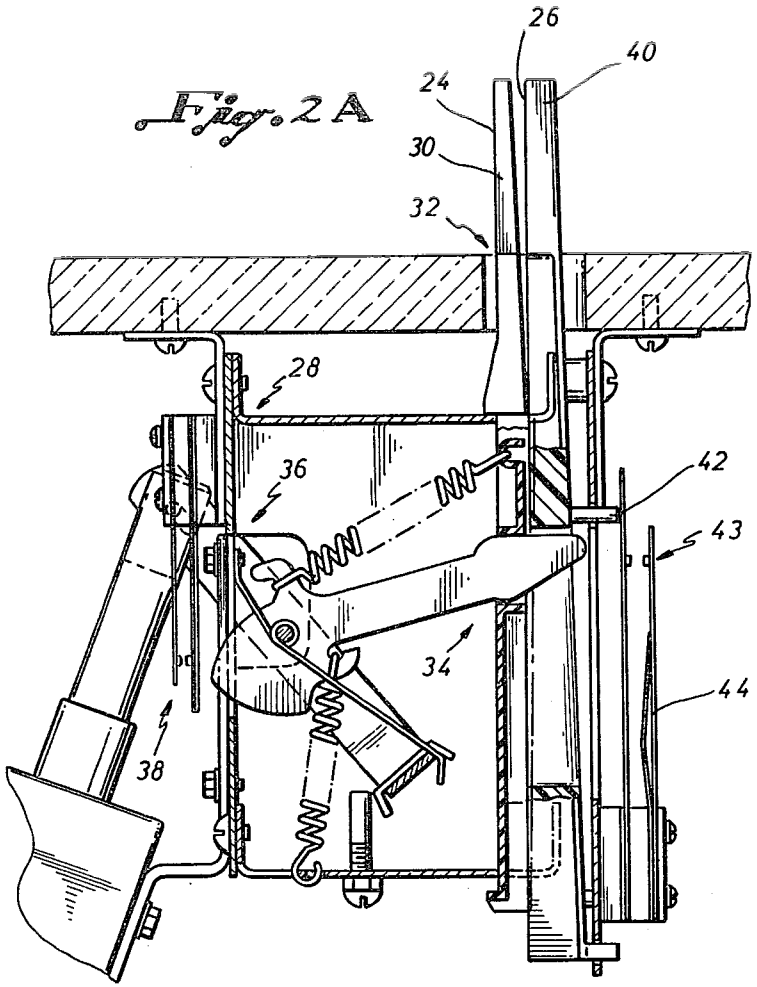

Referring to FIGS. 2A, 2B and 3, an embodiment of the present invention is shown wherein the drop target assembly 22 provides multiple target means 24, 26 arranged such that the first target area 24 is immediately in front of the second target area 26; i.e. the area 24 is disposed on the sloped playfield surface at a position closer to the flippers 18 than the area 26. In this configuration the first scoring area 24 shields the second scoring area 26 from ball engagement when the first scoring area 24 is in a position above the surface of the playfield 12.

In more detail, a frame assembly 28 is secured to the bottom surface of the playfield 12. A plurality of sliding target members 30 are movably supported within the frame assembly 28 for vertical travel, i.e., travel in a direction transverse to the plane of the playfield. Each of the sliding target members 30 has its first target area 24 at an end, and each target area 24 extends through an opening 32 in the playfield 12. A moving mechanism 34 is provided for vertically advancing the sliding target members 30 upwardly and downwardly through the opening 32 in accordance with usual drop target operation. The moving mechanism also includes a reset mechanism 36 for advancing the sliding target members 30 upwardly through the opening 32 until the respective target areas 24 extend above the playfield 12 in a ball engageable position.

The moving mechanism 34 also includes means for holding each of the sliding target members 30 in this above-playfield surface position until the ball 14 engages the respective target area 24. Upon such ball engagement, the moving mechanism 34 drops the corresponding one of the sliding target members 30 until the target area 24 is below the surface of the playfield. A set of switch contacts 38 may be provided to each of the sliding target members 30 to detect downward travel thereof; i.e. to detect ball actuation of the corresponding target area 24 for dropping the target.

The electrical contacts 38 are positioned with respect to the moving mechanism 34 so that as the moving mechanism 34 drops the sliding target member 30 it engages the electrical contacts 38 and closes them.

As described to this point, the structure and operation of the moving mechanism 34, the reset mechanism 36, and the contacts 38 are conventional. This structure is shown and described in the Krynski patent which is specifically incorporated herein by reference.

According to an outstanding feature of the invention, a second set of target members 40 are provided, each of which has an end which defines one of the target areas 26. A given target member 40 corresponds to an associated sliding target members 30, and it is disposed immediately behind the corresponding member 30. That is, the target member 40 is disposed so that the target area 26 is shielded from ball engagement by the target area 24 when the target area 24 is in the above-surface position.

In the preferred and illustrated embodiment, each of the target members 40 is supported with respect to the frame assembly 28 for movement in only the general direction parallel to the plane of the playfield. Thus in this embodiment the members 40 do not define drop targets. It is suitably within, and contemplated by, the invention to include a plurality of such sliding target members 30 one in front of the other, all of which are in front of the non-dropping target member 40. In this configuration, ball engagement of the first of the sliding target members 30 would then expose the next in line sliding target member 30 etc. until reaching the non-dropping target member 40.

Referring to FIGS. 2A, 2B and 3, each of the target members 40 has a laterally extending projection 42. The projection 42 extends through apertures in the frame assembly 28 a distance to engage a second of electrical contacts 43 which are disposed behind the target members 40. The distance between the projection 42 and the contacts 43 is selected to maintain the set of contacts 43 in one state, such as open, in the quiescent or non-ball actuated condition of the target areas 24, 26 but which changes the state of the contacts, i.e., closes them, upon ball engagement of the target areas 24, 26. In other words, ball engagement of the target area 24 to unlatch the member 30 causes rearward travel of not only the member 30, but also rearward travel of the member 40 and the rejection 42, thereby actuating the contacts 43. In the illustrated embodiment, the set of contacts 43 is on a supporting element 44 of sufficient resiliency to urge the target member 40 forward to the quiescent state, yet allow rearward travel of the member 40 to close the contacts 43 upon ball engagement of the target areas 24, 26.

Accordingly, initial ball engagement of the sliding target member 30 causes actuation of the electrical contacts 38. Further ball engagement with the member 30 actuates its contacts 43. Accordingly, actuation of the electrical contacts 38 corresponds to actuation of the target area 24 and all actuations of the electrical contacts 43 correspond to actuation of the target area 26.

It is understood that the set of electrical contacts 38 is not a necessary part of the invention. The single set of contacts 43 could be utilized such that the first actuation thereof corresponded to ball engagement of the target area 24 and all subsequent actuations corresponded to actuation of the target area 26. Since present pinball games commonly employ computer control systems, it is a relatively simple matter for the computer to be programmed to detect switch contact closures and to keep track of the number and sequence of actuations thereof, such as of the electrical contacts 43.

A prior embodiment has suggested that the target areas 24, 26 for a given drop target location be placed on a single target member 30. To accommodate the additional target area 26 the respective sliding targets 30 were to be of increased length so that an additional length of the respective targets 30 extended above the surface of the playfield 12.

This prior art embodiment is described in detail in copending patent application Ser. No. 234,731, filed concurrently herewith in the name of Edward P. Krynski and assigned to the assignee of the present invention. This application is incorporated herein by reference.

It will therefore be appreciated that a new and improved drop target assembly has been disclosed. The drop target assembly provides multiple target areas for increasing player appeal and promoting attractiveness of game play.

Although the invention has been described in its preferred form with a certain degree of particularity, it is understood that the present disclosure has been made only by way of example. Numerous changes in the details and construction of the combination and arrangement of parts will be apparent without departing from the spirit and the scope of the invention.

What is claimed is:

1. An improved drop target assembly for a flipper-type pinball game machine comprising:

(a) a frame;

(b) a first target member movably supported by said frame for defining a first target area, said first target member being movable to advance the first target area between a position above the surface of the playfield and a position below the surface of the playfield;

(c) a second target member coupled to and supported by said frame for defining a second target area, the second target member being disposed behind the first target member to enable the second target area to be ball engageable only when the first target area has been advanced to the below-surface position;

(d) a mechanism for moving the first target member thereby to drop the first target area to the below-surface position upon ball engagement therewith and to expose the second target area for ball engagement;

(e) means mounting the second target member to the frame to maintain the second target area above the playfield surface upon ball engagement with the second target; and (f) switch contact means to be actuable upon ball engagement of either the first or second target areas.

2. The drop target assembly according to claim 1 wherein the first and second target members are configured in substantially the same shape but of distinguished visual appearances, thereby promoting player appeal.

3. The improved drop target assembly according to claim 1 and including means for resetting the first target member to advance the first target area to the above-surface position.

4. The improved drop target assembly according to claim 1 wherein the switch contact means comprises a set of switch contacts disposed behind the second target member to be actuable upon ball engagement of either the first or second target areas.

5. The improved drop target assembly according to claim 1 wherein said mounting means supports said second target member for movement substantially only in a direction transverse to the direction of movement of the first target member when the first target member advances between the above and below-surface positions.

6. In a flipper-type pinball game machine of the type having an inclined playfield which supports a rolling ball and one or more drop target assemblies, each drop target assembly having a ball engageable target member which extends through an opening in the playfield to define a ball engageable target area and which is movable to advance the target area between a position above the surface of the playfield and a position below the surface of the playfield, the improved drop target assembly comprising:

(a) a frame;

(b) at least first and second targets;

(c) means for movably coupling the first and second targets to the frame such that the first target is movable between a position above the surface of the playfield and a position below the surface of the playfield and the first and second targets are disposed so that the first target shields the second target from ball engagement when the first target is in the above-surface position;

(d) a mechanism for moving the first target to the below-surface position upon ball engagement of the first target without advancing the second target area to a non-ball engageable position, thereby exposing said second target for ball engagement;

(e) said supporting means including means for maintaining the second target above the playfield surface upon ball engagement with the second target; and (f) switch contact means to be actuable upon ball engagement of either the first or second target areas.

* * * * *

UNITED STATES PATENT OFFICE

CERTIFICATE OF CORRECTION

Patent No. 4,354,681 Dated October 19, 1982

Inventor(s) Roman F. Garbark

It is certified that error appears in the above-identified patent and that said Letters Patent are hereby corrected as shown below:

In the abstract, line 11, delete "[exposed]".

Column 1, line 43, change "firs" to -- first --.

Column 2, line 47, change "annular" to -- angular --; line 51, change "means" to -- areas --; and, line 53, insert a comma after "i.e."

Column 3, line 17, insert a comma after "i.e."

Signed and Sealed this

*Twenty-eighth* Day of *December 1982*

[SEAL]

*Attest:*

GERALD J. MOSSINGHOFF

*Attesting Officer* *Commissioner of Patents and Trademarks*